US006327777B1

(12) United States Patent
Ide et al.

(10) Patent No.: US 6,327,777 B1
(45) Date of Patent: Dec. 11, 2001

(54) CONNECTING STRUCTURE FOR COVERED WIRES

(76) Inventors: Tetsuro Ide; Satoshi Tanikawa, both of c/o Yazaki Parts Co., Ltd., 206-1, Nunobikibara, Haibara-cho, Haibara-gun Shizuoka-ken (JP)

( * ) Notice: Subject to any disclaimer, the term of this patent is extended or adjusted under 35 U.S.C. 154(b) by 0 days.

(21) Appl. No.: 09/413,542

(22) Filed: Oct. 6, 1999

Related U.S. Application Data

(62) Division of application No. 09/260,470, filed on Mar. 2, 1997, now Pat. No. 6,046,407.

(30) Foreign Application Priority Data

Mar. 3, 1998 (JP) ..... 10-50958

(51) Int. Cl.[7] ..... H01R 43/04; H01R 4/00
(52) U.S. Cl. ..... 29/868; 29/872; 174/84 R
(58) Field of Search ..... 174/84 R, 72 C, 174/72 TR, 75 B, 76, 77 R, 117 F, 73.1; 29/856, 858, 868, 872

(56) References Cited

U.S. PATENT DOCUMENTS

| | | | | |
|---|---|---|---|---|
| 5,584,122 | | 12/1996 | Kato et al. | 29/872 |
| 5,869,784 | | 2/1999 | Shinichi | 174/84 R |
| 5,922,993 | | 7/1999 | Ide et al. | 174/84 R |
| 5,925,202 | | 7/1999 | Ide et al. | 156/73.2 |
| 5,929,384 | | 7/1999 | Ide et al. | 174/84 R |
| 5,959,252 | * | 9/1999 | Ide et al. | 174/84 R |
| 6,004,170 | * | 12/1999 | Kato et al. | 439/874 |
| 6,072,124 | * | 6/2000 | Kato et al. | 174/84 R |

FOREIGN PATENT DOCUMENTS

| | | | |
|---|---|---|---|
| 0 838 883 A2 | * | 4/1997 | (EP) . |
| 834 956 A2 | | 4/1998 | (EP) . |
| 838 883 A2 | | 4/1998 | (EP) . |
| 7-320842 | | 12/1995 | (JP) . |

* cited by examiner

*Primary Examiner*—Dean A. Reichard
*Assistant Examiner*—William H. Mavo, III

(57) ABSTRACT

A connecting structure for covered wires is provided. At first, a shield wire 1 and a ground wire 2 are prepared. After overlaying the ground wire 2 on the shield wire 1 cross each other, respective overlapping portions of the wires 1, 2 are interposed between an upper resin tip 13 and a lower resin tip 14. Next, the upper and lower resin tips 13, 14 are oscillated with ultrasonic waves while compressing the upper and lower resin tips 13, 14 from the outside. Consequently, respective outside rinds 1*d*, 2*b* of the wires 1, 2 are molten for removal, so that a braided wire 1*c* comes into electrical contact with a core line 2*a*. The upper and lower resin tips 13, 14 have wire receiving grooves 13*a*, 14*a* formed on their butt faces. Each of the groove 13*a*, 14*a* has a semi-circular cross section of a diameter corresponding to the diameter of the shield wire 1. The upper resin tip 13 is provided, at an intermediate portion of the wire receiving groove 13*a* in the longitudinal direction, with a press part 13*b* for urging the ground wire 2 against the shield wire 1.

4 Claims, 2 Drawing Sheets

CONNECTING STRUCTURE FOR COVERED WIRES

This is a division of application Ser. No. 09/260,470 (now U.S. Pat. No. 6,072,123), filed Mar. 2, 1992, which is incorporated herein by reference.

BACKGROUND OF THE INVENTION

1. Field of the Invention

The present invention relates to a connecting structure for covered wires where their respective conductors are connected to each other by oscillating respective insulating covers of the wires with ultrasonic waves. More particularly, it relates to a connecting structure which is effective to connect a shield wire with a ground wire.

2. Description of the Related Art

Generally, it is complicated and troublesome to handle a shield wire having a braided wire coaxially disposed around a core line (or core lines) with the deteriorated workability in using the shield wire. As an effective measure for improving the deteriorated workability, there is provided a connecting structure for wires which takes advantage of inside heating due to the ultrasonic oscillation by Japanese Unexamined Patent Publication (kokai) No. 7-320842.

In the publication, there are shown two kinds of covered wires. One is a shield wire which comprises a core line, an inside insulating rind arranged outside the core line, a braided wire as a shield conductor arranged outside the inside insulating rind, and an outside insulating rind. The other is a ground wire consisting of a core line and an outside resinous rind arranged outside the core line.

According to the disclosed method of connecting the braided wire of the shield wire being connected to a connector, to the core line of the ground wire being also connected to the connector, in front of the connector, the ground wire is firstly overlaid on the shield wire so as to cross each other at a connection point. Next, the overlapping portions are interposed between upper and lower resin tips. Then, while compressing the upper and lower resin tips from the outside, they are subjected to ultrasonic oscillation by making use of an ultrasonic horn and an anvil. Consequently, both of the outside rinds of the shield wire and the ground wire are molten for elimination, so that the braided wire of the shield wire comes into electrical contact with the core line of the ground wire. Simultaneously, the upper and lower resin tips are mutually welded to each other thereby to seal up the surroundings of the above connecting point. Note, in the modification, there is a case that the upper and lower resin tips are respectively provided, on bearing faces thereof, with wire-accommodating shallow grooves for positioning the shield wire.

However, the above-mentioned connecting structure has a problem that much covering resin, in other words, molten resin which is expected to be removed by the ultrasonic oscillation does remain around a contact between conductors. In such a case, the endurance test against thermal shock etc. would cause the covering resin to be deformed and therefore, the contact between the conductors would be displaced thereby to increase the resistance of the contact disadvantageously. Additionally, there is sometimes observed a phenomenon that, when welding the upper and lower resin tips to each other, the molten covering resin causes the outside insulating rind of the shield to be torn or broken. In such a case, the fixing force between the integrated resin tips and the shield wire, i.e. the strength of connection is lowered with a reduction of insulating effect owing to the integrated tips.

SUMMARY OF THE INVENTION

Under such a circumstance, it is therefore an object of the present invention to provide a connecting structure for covered wires, which is capable of defining a flow of the molten resin during the ultrasonic welding, whereby the electrical connecting performance can be stabilized to prevent both connecting strength and insulating performance from being lowered.

The object of the present invention described above can be accomplished by a connecting structure for covered wires, comprising:

- a first covered wire having a first conductor covered with a first resinous cover;
- a second covered wire having a second conductor covered with a second resinous cover, the second conductor being electrically connected with the first conductor of the first covered wire cross each other; and
- an upper resin tip and a lower resin tip between which an electrical connecting part of the first and second conductors and the surroundings are interposed, the upper resin tip being welded to the lower resin tip while interposing the first and second covered wires between the upper resin tip and the lower resin tip;
- wherein each of the upper and lower resin tips is provided, on its butt face being abutted against the other resin tip, with a wire receiving groove for receiving the first covered wire, an intermediate portion of the wire receiving groove in the longitudinal direction being established as a connecting part between the first covered wire and the second covered wire; and
- wherein the wire receiving groove is provided, adjacent the connecting part, with at least one recess for receiving molten resin resulting from the melting of the first and second resinous covers.

With the above-mentioned connecting structure, owing to the provision of at least one recess on either one or both sides of the connecting part, the molten resin produced by the ultrasonic oscillation flows into the recess(es). Therefore, the molten resin can be withdrawn from the connecting part rapidly, whereby it is possible to accomplish the connecting between the first and second conductors smooth. Furthermore, with a reduced quantity of the molten resin staying around the connecting part, it is possible to reduce the bad influence of the molten resin on the contact, whereby the electrical connecting performance can be stabilized. Since the molten resin can be collected in the recess(es), there can be excluded a possibility that the first and second resinous covers outside the first and second resin tips are damaged by the molten resin, so that it is possible to avoid a deterioration in the fixing force between the first and second covered wires at the connecting part, which might be caused due to the damage to the first and second resinous covers, and also avoid a deterioration in the insulating performance.

In the above-mentioned structure, preferably, the first covered wire is a shield wire, while the second wire is a ground wire and wherein the first conductor is a shield conductor of the shield wire, while the second conductor is a core line of the ground wire.

With the above-mentioned connecting structure, since the molten resin produced by the ultrasonic oscillation flows into the recess(es), it is possible to accomplish the connecting between the shield conductor of the shield wire and the core line of the ground wire smooth. Also in this case, with the reduced quantity of the molten resin staying around the connecting part between the shield conductor and the core line, it is possible to reduce the bad influence of the molten resin on the contact, whereby the electrical connecting performance can be stabilized. Since the molten resin can be collected in the recess(es), there can be excluded a possibility that the first resinous cover of the shield wire outside the first and second resin tips is damaged by the molten resin, so that it is possible to avoid a deterioration in the fixing force between the shield wire and the connecting part, which might be caused due to the damage to the first resinous cover, and also avoid a deterioration in the insulating performance due to the exposure of the shield conductor.

Preferably, the upper resin tip is provided, outside the recess in the longitudinal direction, with a damming part for checking a leakage of the molten resin over the recess.

Owing to the further provision of the damming part outside the recess, it is possible to check the leakage of the molten resin from the recess to the outside certainly. That is, it is possible to avoid the damage to the first resinous cover of the first covered wire, whereby the retaining capability against the first covered wire can be improved. Further, it is possible to prevent the first conductor of the first covered wire from being exposed, thereby enhancing the insulating effect.

Note, in the connecting structure, the recess may be formed beside the connecting part discontinuously.

Further, preferably, the wire receiving groove is provided, on both sides of the connecting part, with a pair of recesses for receiving molten resin resulting from the melting of the first and second resinous covers.

Owing to the provision of the damming parts outside the recesses, it is possible to check the leakage of the molten resin from the recesses to the outside more certainly.

According to the present invention, there is also provided a method of producing a connecting structure for covered wires, the method comprising the steps of:

preparing a first covered wire having a first conductor covered with a first resinous cover and a second covered wire having a second conductor covered with a second resinous cover;

overlaying the second covered wire on the first covered wire cross each other;

interposing respective overlapping portions of the first and second covered wires between an upper resin tip and a lower resin tip; and oscillating the upper and lower resin tips with ultrasonic waves while compressing the upper and lower resin tips from the outside, whereby the first and second resinous covers of the first and second covered wires are molten for removal thereby to bring the first conductor of the first covered wire into electrical contact with the second conductor of the second covered and simultaneously, the upper and lower resin tips are mutually welded to each other thereby to seal up the surroundings of a contact between the first conductor and the second conductor;

wherein each of the upper and lower resin tips is provided, on its butt face being abutted against the other resin tip, with a wire receiving groove whose intermediate portion in the longitudinal direction is established as a connecting part between the first covered wire and the second covered wire; and wherein the wire receiving groove is provided, adjacent the connecting part, with at least one recess for receiving molten resin resulting from the melting of the first and second resinous covers.

In the above-mentioned method, preferably, the first covered wire is a shield wire, while the second wire is a ground wire and wherein the first conductor is a shield conductor of the shield wire, while the second conductor is a core line of the ground wire.

In the above-mentioned method, preferably, the upper resin tip is provided, outside the recess in the longitudinal direction, with a damming part for checking a leakage of the molten resin over the recess.

In the above-mentioned method, preferably, the recess is formed beside the connecting part discontinuously.

In the above-mentioned method, preferably, the wire receiving groove is provided, on both sides of the connecting part, with a pair of recesses for receiving molten resin resulting from the melting of the first and second resinous covers.

These and other objects and features of the present invention will become more fully apparent from the following description and appended claims taken in conjunction with the accompany drawings.

BRIEF DESCRIPTION OF THE DRAWINGS

FIGS. 1A and 1B are views showing resin tips constituting a connecting structure in accordance with the first embodiment of the present invention, in which FIG. 1A is a perspective view showing an upper resin tip turned over and FIG. 1B is a perspective view showing a lower resin tip; and FIGS. 2A and 2B show the connecting structure of the first embodiment, in which FIG. 2A is a perspective view of the connecting structure and FIG. 2B is a cross sectional view of the connecting structure, taken along a line IIb—IIb of FIG. 2A.

DESCRIPTION OF THE PREFERRED EMBODIMENT

U.S. Pat. No. 5,584,122, Kato et al., issued on Dec. 17, 1996 is characterized by reference herein in its entirety. Embodiments of the present invention will be described with reference to drawings.

Figure 1A:
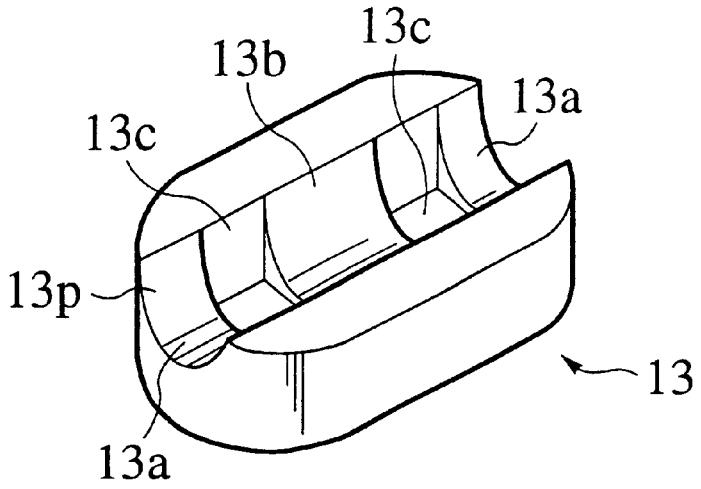
Figure 1B:
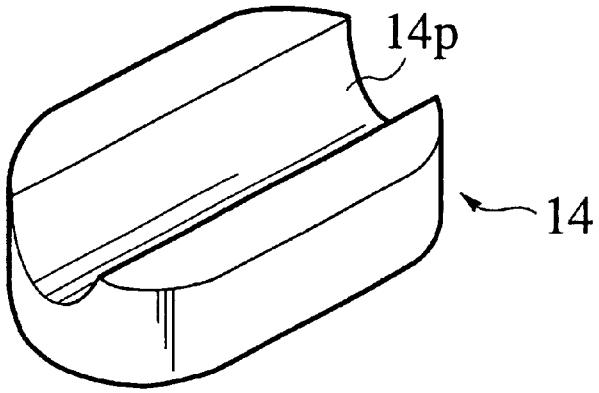

FIGS. 1A and 1B show resin tips constituting the connecting structure in accordance with the first embodiment of the present invention. FIG. 1A shows an upper resin tip 13 turned over, while FIG. 1B shows a lower resin tip 14.

Each of the resin tips 13, 14 is constituted by a plate body having a profile of an elongated circle in its plan view. Formed on respective butt faces (i.e. mutual contact faces being welded) of the upper and lower resin tips 13, 14 are wire receiving grooves 13*p*, 14*p* each of which extends along a direction of the long axis of the elongated circle and has a semicircular cross section. In the embodiment, together with the wire receiving groove 14*p* of the lower resin tip 14, the wire receiving groove 13*p* of the upper resin tip 13 is formed, at both end portions thereof in the longitudinal direction, to have a diameter so as not to force an outside rind 1*d* of a shield wire 1 (FIG. 2A) intensely, that is, a diameter substantially equal to a diameter of the rind 1*d*. Note, the end portions of the wire receiving groove 13*p* correspond to damming parts 13*a* described later.

Additionally, the upper resin tip 13 is provided, at an intermediate portion of the wire receiving groove 13*p* in the longitudinal direction, with a press part 13*b* which can urge a ground wire 2 against the shield wire 1 due to a reduced depth of the groove 13*p*. The position of the press part 13*b* corresponds to a part of the shield wire 1 overlapping with the ground wire 2, that is, an electrical connecting part between the shield wire 1 and the ground wire 2. On both sides of the press part 13*b*, recesses 13*c* are formed to receive a molten resin (covering resin) 5 produced during the ultrasonic oscillation on the outside rind 1*d* of the shield wire 1 and an outside rind 2*b* of the ground wire 2. The size of each recess 13*c* is appropriately established corresponding to a quantity of molten resin being expected. The damming parts 13*a* are respectively disposed outside the recesses 13*c*, for preventing the molten resin from overflowing to the outside. Repeatedly, the cross section of each damming part 13*a* is contoured so as not to oppress the outside rind 1*d* of the shield wire 1 intensely.

Figure 2A:
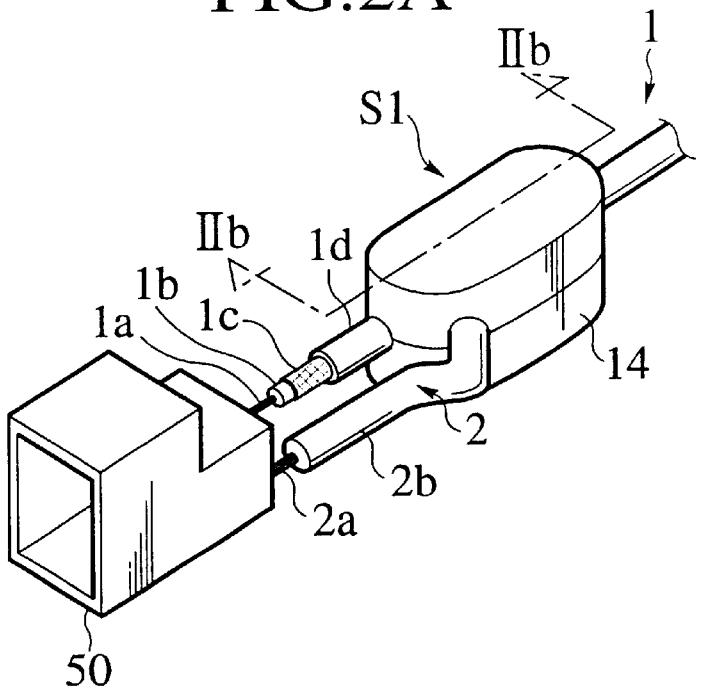
Figure 2B:
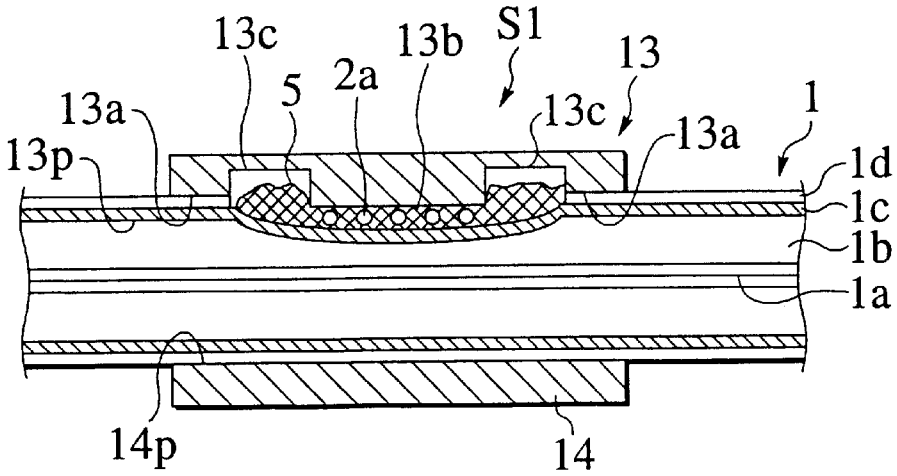

In order to connect the shield wire 1 to the ground wire 2, it is firstly overlaid on the shield wire 1 so as to cross each other at the electrical connecting part. Next, after interposing the overlapping portions of the wires 1, 2 between the upper resin tip 13 and the lower resin tip 14, the portions are subjected to the ultrasonic oscillation by making use of an ultrasonic horn 7 and an anvil 8 while compressing the upper and lower resin tips 13, 14 from the outside. Consequently, both of the outside rind 1*d* of the shield wire 1 and the outside rind 2*b* of the ground wire 2 are molten for elimination, so that a braided wire 1*c* of the shield wire 1 i.e. shield conductor comes into electrical contact with a core line(s) 2*a* of the ground wire 2. Simultaneously, the upper and lower resin tips 13, 14 are mutually welded to each other thereby to seal up the surroundings of the above connecting part. In this way, it can be obtained a connecting structure S1 between the shield wire 1 and the ground wire 2, which is shown in FIGS. 2A and 2B. Note, in FIG. 2A, reference numeral 50 designates a connector to which a core line 1*a* of the shield wire 1 and the core line 2*a* are connected.

According to the resultant connecting structure S1, owing to the provision of the recesses 13*c* on both sides of the overlapping portions of the wires 1, 2, the molten resin 5 resulting from the ultrasonic oscillation does flow into the recesses 13. Thus, since the molten resin 5 is rapidly withdrawn from the connecting part at the ultrasonic oscillation, it is possible to accomplish the connecting of the braided wire 1*c* of the shield wire 1 with the core line 2*a* of the ground wire 2 smooth. Furthermore, as shown in FIG. 2B, with the reduced quantity of the molten resin 5 staying around the connecting part (contact) between the braided wire 1*c* and the core line 2*a*, it is possible to reduce the bad influence of the molten resin 5 on the contact, whereby the electrical connecting performance can be stabilized. Again, since the molten resin 5 is collected in the recesses 13*c* in the resin tips 13, 14, there can be excluded a possibility that the outside rind 1*d* out of the resin tips 13, 14 is damaged by the molten resin 5, so that it is possible to avoid a deterioration in the fixing force of the shield wire 1 in the connecting structure S1, which may be caused by the damage to the outside rind 1*d*, and also avoid a deterioration in the insulating performance due to an exposure of the braided wire 1*c*.

Owing to the further provision of the damming parts 13*a* outside the recesses 13*c*, it is possible to check the leakage of the molten resin 5 from the recesses 13*c* to the outside certainly. That is, it is possible to avoid the damage to the outside rind 1*d* of the shield wire 1, whereby the retaining capability against the shield wire 1 can be improved. Further, it is possible to prevent the braided wire 1*c* of the shield wire 1 from being exposed, thereby enhancing the insulating effect.

Now, it will be understood by those skilled in the art that the foregoing description is related to one preferred embodiment of the disclosed connecting structure, and that various changes and modifications may be made to the present invention without departing from the spirit and scope thereof.

For example, although two recesses 13*c*, 13*c* are provided on both sides of the press part 13*b* in the above-mentioned embodiment, an only recess may be provided in one side of the press part 13*b* in the modification. Moreover, although each recess 13*c* is continuously formed beside the press part 13*b* in the embodiment, the recess(es) 13*c* may be discontinuously formed by the part 13*b* in the modification.

What is claimed is:

1. A method of producing a connecting structure for covered wires, the method comprising the steps of:

preparing a first covered wire having a first conductor covered with a first resinous cover and a second covered wire having a second conductor covered with a second resinous cover;

overlaying the second covered wire on the first covered wire so that the first and second wires cross each other;

interposing respective overlapping portions of the first and second covered wires between an upper resin tip and a lower resin tip; and oscillating the upper and lower resin tips with ultrasonic waves while compressing the upper and lower resin tips from an outside of the upper and lower resin tips, whereby the first and second resinous covers of the first and second covered wires are melted for removal thereby to bring the first conductor of the first covered wire into electrical contact with the second conductor of the second covered wire and simultaneously, to mutually weld the upper and lower resin tips to each other thereby to seal up surroundings of a contact between the first conductor and the second conductor;

wherein each of the upper and lower resin tips are provided, on their butt faces being abutted against one another, with a wire receiving groove, an intermediate portion of the wire receiving groove of at least one of the upper and lower resin tips in the longitudinal direction being established as a concave connecting part for maintaining the first covered wire on the second covered wire; and wherein the wire receiving groove of at least one of the upper and lower resin tips further includes at least one recess formed in succession with the concave connecting part to receive molten resin resulting from melting of the first and second resinous covers at the overlapping portions of the first and second covered wires.

2. A method as claimed in claim 1, wherein the first covered wire is a shield wire, while the second covered wire is a ground wire and wherein the first conductor is a shield conductor of the shield wire, while the second conductor is a core line of the ground wire.

3. A method as claimed in claim 1, wherein the wire receiving groove of the upper resin tip is provided with the at least one recess, and wherein the wire receiving groove further includes a damming part successively formed outside the at least one recess in the longitudinal direction to check a leakage of molten resin resulting from the melting of the first and second resinous covers over the at least one recess.

4. A method as claimed in claim 1, wherein the at least one recess for receiving molten resin includes a recess on each side of the concave connecting part in the longitudinal direction of the wire receiving groove of at least one of the upper and lower resin tips.

* * * * *

UNITED STATES PATENT AND TRADEMARK OFFICE

CERTIFICATE OF CORRECTION

PATENT NO. : 6,327,777 B1
DATED : December 11, 2001
INVENTOR(S) : Tetsuro Ide and Satoshi Tanikawa It is certified that error appears in the above-identified patent and that said Letters Patent is hereby corrected as shown below:

Title page,
Item [62], Related U.S. Application Data, "1997, now Pat No. 6,046,407" should read -- 1999, now Pat No. 6,072,123 --.

Signed and Sealed this

Twenty-third Day of July, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,327,777 B1
DATED : December 11, 2001
INVENTOR(S) : Tetsuro Ide and Satoshi Tanikawa It is certified that error appears in the above-identified patent and that said Letters Patent is hereby corrected as shown below:

Title page,
Insert -- [73] Assignee: Yazaki Corporation, Tokyo (JP) --

Signed and Sealed this

Twenty-seventh Day of August, 2002

*Attest:*

*Attesting Officer*

JAMES E. ROGAN
*Director of the United States Patent and Trademark Office*